US008845310B2

(12) United States Patent
Iitsuka et al.

(10) Patent No.: US 8,845,310 B2
(45) Date of Patent: Sep. 30, 2014

(54) SCROLL COMPRESSOR WITH COVER COVERING DRIVING SHAFT OF DRIVING MOTOR

(75) Inventors: Satoshi Iitsuka, Moriguchi (JP); Tsutomu Kon, Moriguchi (JP); Akihiro Hayashi, Moriguchi (JP); Katsuki Akuzawa, Moriguchi (JP); Kazuyoshi Sugimoto, Moriguchi (JP); Yasunori Kiyokawa, Moriguchi (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 151 days.

(21) Appl. No.: 13/585,264

(22) Filed: Aug. 14, 2012

(65) Prior Publication Data

US 2013/0052068 A1 Feb. 28, 2013

(30) Foreign Application Priority Data

Aug. 31, 2011 (JP) ..... 2011-188490

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |
| ***F04C 29/02*** | (2006.01) |
| ***F04C 18/02*** | (2006.01) |

(52) U.S. Cl.

CPC ..... *F04C 29/021* (2013.01); *F04C 18/0215* (2013.01); *F04C 18/0246* (2013.01); *F04C 29/028* (2013.01)

USPC ..... 418/55.1; 418/55.6; 418/88; 418/94

(58) Field of Classification Search

CPC ..... F04C 18/0215; F04C 18/0246; F04C 23/008; F04C 29/02; F04C 29/023; F04C 29/025; F04C 29/026; F04C 29/028; F04C 29/06; F04C 29/0085; F04C 2240/10; F04C 2240/52; F04C 2240/603; F04C 2240/809; F01C 1/0215

USPC ..... 418/55.1–55.6, 57, 88, 94, 270, DIG. 1; 417/310

See application file for complete search history.

(56) References Cited

U.S. PATENT DOCUMENTS 5,064,356 A 11/1991 Horn
RE34,297 E * 6/1993 Elson ..... 417/372

(Continued)

FOREIGN PATENT DOCUMENTS

JP 2003-293955 A 10/2003
JP 2004-060532 A 2/2004

(Continued)

OTHER PUBLICATIONS

JP 2010213527A—Tsukamoto et al. , Stator, Motor and Compressor, Sep. 24, 2010—English Translation.*

(Continued)

*Primary Examiner* — Theresa Trieu

(74) *Attorney, Agent, or Firm* — Westerman, Hattori, Daniels & Adrian, LLP

(57) ABSTRACT

A scroll compressor including a casing, a scroll compression mechanism that compresses refrigerant, a driving motor that has a driving shaft, an insulator and a stator, and is connected to the scroll compression mechanism through the driving shaft to drive the scroll compression mechanism, a main frame that supports the scroll compression mechanism in the casing, a bearing plate that has a boss portion in which the driving shaft is inserted, and supports the driving shaft of the driving motor in the casing, and a cover that covers the surrounding of the driving shaft between the driving motor and the bearing plate and is formed of an insulating material and provided to the insulator of the driving motor.

4 Claims, 2 Drawing Sheets

(56) References Cited

U.S. PATENT DOCUMENTS

| | | | | |
|---|---|---|---|---|
| 5,593,294 | A * | 1/1997 | Houghtby et al. | 418/55.1 |
| 2006/0127262 | A1 | 6/2006 | Shin et al. | |
| 2008/0069714 | A1 | 3/2008 | Bonifas | |

FOREIGN PATENT DOCUMENTS

| | | | | |
|---|---|---|---|---|
| JP | 2010213527 | A * | 9/2010 | H02K 3/46 |
| WO | 2010/103871 | A1 | 9/2010 | |

OTHER PUBLICATIONS

Extended European Search Report dated Nov. 28, 2012, issued in corresponding European patent application No. 12181853.8.

* cited by examiner

SCROLL COMPRESSOR WITH COVER COVERING DRIVING SHAFT OF DRIVING MOTOR

INCORPORATION BY REFERENCE

The present application claims priority under 35 U.S.C. §119 to Japanese Patent Application No. 2011-188490 filed on Aug. 31, 2011. The content of the application is incorporated herein by reference in its entirety.

BACKGROUND OF THE INVENTION

1. Field of the Invention

The present invention relates to a scroll compressor for supplying lubricant oil to the engaging portion between a fixed scroll and a swinging scroll and compressing refrigerant through the engagement between the fixed scroll and the swinging scroll.

2. Description of the Related Art

There is known a scroll compressor equipped with a compression mechanism comprising a fixed scroll and a swinging scroll that have spiral wraps engaged with each other in a hermetically sealed casing. In this scroll compressor, the compression mechanism is driven by a driving motor so that the swinging scroll makes circular motion relatively to the fixed scroll without rotating to compress refrigerant (see JP-A-2004-60532, for example).

In this type of scroll compressor, low-pressure refrigerant sucked from a suction pipe is compressed by the compression mechanism, and compressed high-pressure refrigerant is discharged from a discharge pipe provided to the casing to the outside of the casing. Furthermore, lubricant oil is supplied to each sliding portion of the compression mechanism and the engaging portion between the fixed scroll and the swinging scroll. The lubricant oil to be supplied is stocked in an oil reservoir provided at the lower portion of the casing, and surplus lubricant oil in the compression mechanism is returned to the oil reservoir by its own weight.

There is a case in this type of scroll compressor that lubricant oil is atomized in the casing due to rotation of a rotating body such as a driving shaft of the driving motor or the like. The atomized lubricant oil is mixed with high-pressure gas refrigerant to form mixed gas. The lubricant oil cannot be well separated from the mixed gas, and there may occur such a state that a large amount of atomized lubricant oil exists in the casing. Under the state that the mixed gas of a large amount of atomized lubricant oil and high-pressure refrigerant exists, a large amount of atomized lubricant oil may discharged from the discharge pipe to the outside of the casing together with the high-pressure refrigerant.

SUMMARY OF THE INVENTION

The present invention has been implemented in view of the foregoing situation, and has an object to provide a scroll compressor that can reduce a discharge amount of lubricant oil to the outside of a casing.

In order to attain the above object, there is provided a scroll compressor, comprising a casing, a scroll compression mechanism that compresses refrigerant, a driving motor that has a driving shaft, an insulator and a stator, and is connected to the scroll compression mechanism through the driving shaft to drive the scroll compression mechanism, a main frame that supports the scroll compression mechanism in the casing, a bearing plate that has a boss portion in which the driving shaft is inserted, and supports the driving shaft of the driving motor in the casing, and a cover that covers the surrounding of the driving shaft between the driving motor and the bearing plate and is formed of an insulating material and provided to the insulator of the driving motor (specifically, provided to the insulator of the stator coil of the driving motor).

In the above scroll compressor, the cover may be provided to an inner wall side of the insulator, and the lower end of the cover may extend to a position lower than an upper end surface of the boss portion of the bearing plate.

In the above scroll compressor, the stator may have electromagnetic steel plates, and the upper end of the cover may be provided to be proximate to the lower ends of the electromagnetic steel plates of the stator.

According to the present invention, the lubricant oil which is atomized in the space between the driving motor and the bearing plate due to the rotation of the driving shaft can be enclosed inside the cover, and thus prevented from reaching a gas flow path. Therefore, the discharge amount of the lubricant oil to the outside of the casing can be reduced.

DETAILED DESCRIPTION OF THE EMBODIMENT

An embodiment according to the present invention will be described with reference to the drawings.

Figure 1:
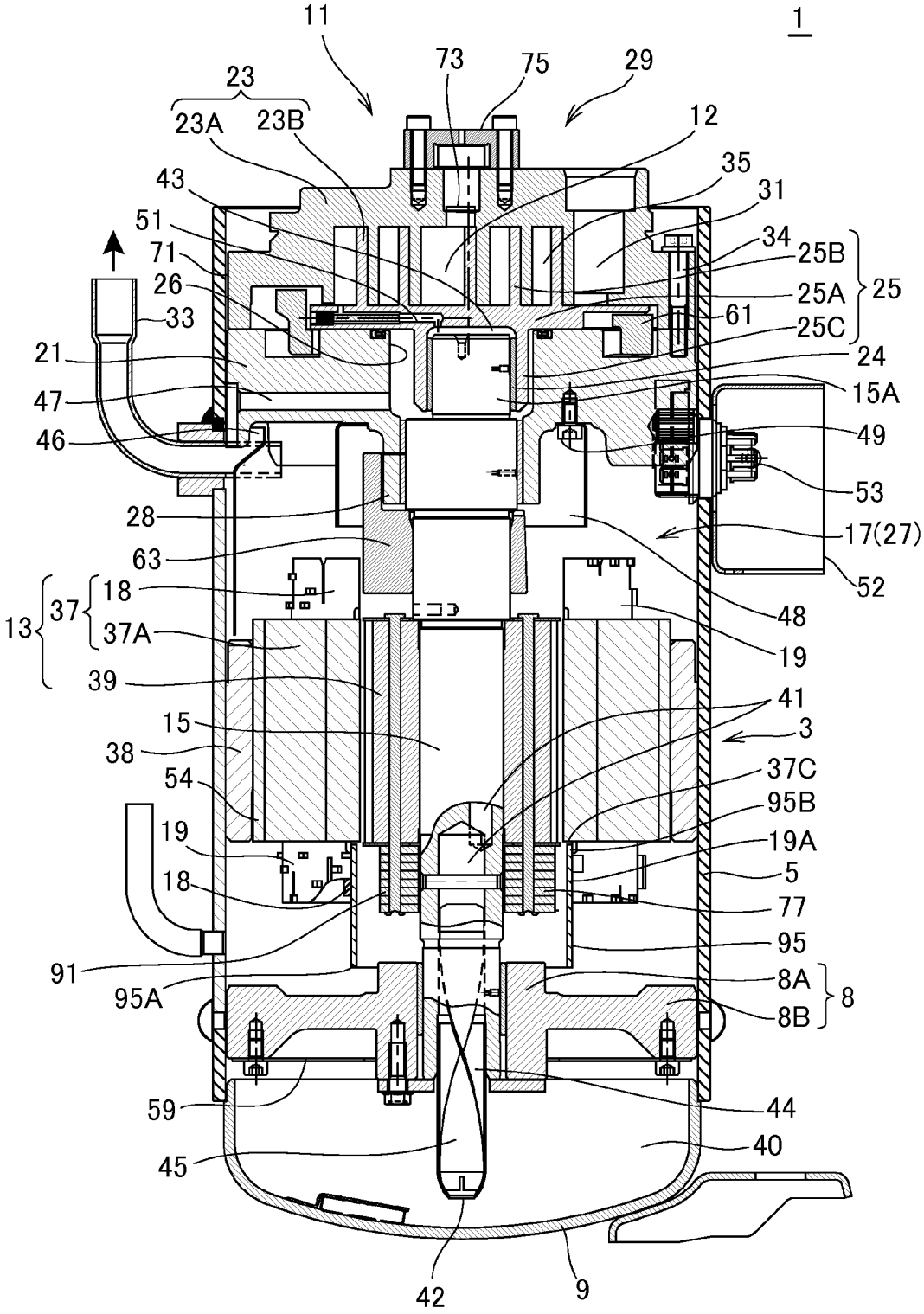
FIG. 1 is a cross-sectional view showing a scroll compressor according to an embodiment of the present invention.

FIG. 1 shows a scroll compressor 1 whose internal pressure is high. The scroll compressor 1 is connected to a refrigerant circuit (not shown) in which refrigerant is circulated to perform a refrigeration cycle operation, and compresses the refrigerant. The scroll compressor 1 has a hermetically-sealed dome type casing 3 which is designed to have an elongated cylindrical shape.

The casing 3 is configured as a pressure container having a casing body 5, an upper cap and a lower cap 9. The casing body 5 constitutes a trunk portion of the casing 3, and designed in a cylindrical (barrel-like) shape having a shaft line extending in the up-and-down direction. The upper cap is configured in a bowl-like shape to have an convex surface projecting to the upper side of the casing 3, and it is air-tightly welded to the upper end portion of the casing body 5 so that the upper cap is integrally joined to the casing body 5. The lower cap 9 is configured in a bowl-like shape to have a convex surface projecting to the lower side of the casing 3, and it is air-tightly welled to the lower end portion of the casing body 5 so that the lower cap 9 is integrally joined to the casing body 5.

A terminal cover 52 is provided to the outer peripheral surface of the casing 3, and a power supply terminal 53 for supplying power to a stator 37 described later is provided in the terminal cover 52.

A scroll compression mechanism 11 for compressing refrigerant and a driving motor 13 disposed at the lower side of the scroll compression mechanism 11 are mounted in the casing 3. The scroll compression mechanism 11 and the driving motor 13 are joined to each other by a driving shaft 15. The driving shaft 15 is disposed along the shaft line extending in the up-and-down direction of the casing 3. A gap space 17 is formed between the scroll compression mechanism 11 and the driving motor 13.

A main frame 21 is mounted at the upper portion of the inside of the casing 3. A radial bearing portion 28 and a boss mount portion 26 are formed at the center of the main frame 21. The radial bearing portion 28 is used to pivotally support the tip (upper end) side of the driving shaft 15. The radial bearing portion 28 is formed by downwardly protruding from the center portion of one surface (lower surface) of the main frame 21. The boss mount portion 26 is provided so that a boss 25C of a swinging scroll 25 described later is mounted therein. The boss mount portion 26 is formed by downwardly recessing the center portion of the other surface (upper surface) of the main frame 21. An eccentric shaft portion 15A is formed at the tip (upper end) of the driving shaft 15. The eccentric shaft portion 15A is provided so that the center thereof is eccentric to the shaft center of the driving shaft 15, and it is turnably inserted in the boss 25C through a slewing bearing 24.

The scroll compression mechanism 11 is constructed by a fixed scroll 23 and a swinging scroll 25. The fixed scroll 23 is disposed in close contact with the upper surface of the main frame 21. The main frame 21 is secured to the inner surface of the casing body 5. The fixed scroll 23 is fastened and fixed to the main frame 21 by a screw 34. The swinging scroll 25 is engaged with the fixed scroll 23, and disposed in a swing space 12 formed between the fixed scroll 23 and the main frame 21. The inside of the casing 3 is partitioned into a high-pressure space 27 below the main frame 21 and a discharge space 29 above the main frame 21. The respective spaces 27 and 29 intercommunicate with each other through a longitudinal groove 71 which is formed on the outer peripheries of the main frame 21 and fixed scroll 23 so as to extend longitudinally.

A suction pipe 31 for introducing refrigerant in the refrigerant circuit to the scroll compression mechanism 11 is air-tightly fixed to the upper cap of the casing 3 so as to penetrate through the upper cap. A discharge pipe 33 for discharging refrigerant in the casing 3 to the outside of the casing 3 is air-tightly fixed to the casing body 5 so as to penetrate through the casing body 5. The suction pipe 31 extends in the up-and-down direction in the discharge space 29. The inner end portion of the suction pipe 31 penetrates through the fixed scroll 23 of the scroll compression mechanism 11, and intercommunicates with a compression chamber 35. Refrigerant is sucked into the compression chamber 35 by the suction pipe 31.

The driving motor (DC driving motor) 13 is a DC (Direct Current) motor which is driven upon reception of input from a DC power source. The driving motor 13 has an annular stator 37 and a rotor 39 which is freely rotatably mounted in the stator 37. The driving motor 13 is driven while the rotation torque of the driving motor 13 is controlled by a PWM (Pulse Width Modulation) inverter which is supplied with a fixed input voltage to control the duty ratio of pulse waves, that is, a pulse wave output period and a pulse width when each pulse wave is output.

The swinging scroll 25 of the scroll compression mechanism 11 is connected to the rotor 39 through the driving shaft 15 to be driven. The stator 37 comprises a stator core 37A and a stator coil 18. The stator core 37A is formed by laminating thin iron plates (electromagnetic steel plates), and it has plural grooves (not shown) therein. The stator coil 18 is formed by winding stator windings of plural phases, and engagedly fitted in the grooves formed in the stator core 37A, whereby the stator coil 18 is provided at the upper and lower sides of the stator core 37A. The stator coil 18 is mounted in the insulator 19. The stator coil 18 is mounted in an insulator 19. The stator coil 18 is connected to the power supply terminal 53 through a conductive wire (not shown).

The rotor 39 is formed of ferrite magnet or neodymium magnet, and it is magnetized by magnetization. The rotor 39 is magnetized by external magnetization. After the rotor 39 is magnetized by using an external magnetizing device, the rotor 37 is interposed in the stator 37.

The stator 37 is supported on the inner wall surface of the casing 3 through the annular spacer ring 38. The spacer ring 38 is fixed to the inner wall surface of the casing 3 by shrink fit, and the stator 37 is fixed to the inner wall surface of the spacer ring 38 by shrink fit. The upper end face of the spacer ring 38 is located at a lower position than the upper end face of the stator 37.

A bearing plate 8 is provided below the driving motor 13, and the lower end portion of the driving shaft 15 is pressed into the bearing plate 8 so as to be rotatably supported by the bearing plate 8. The bearing plate 8 is formed in a cylindrical (barrel-like) shape (see FIG. 2), and it has a boss portion 8A in which the driving shaft 15 is fitted and arm portions 8B fixed to (the inner surface of) the casing body 5. The arm portions 8B are provided on the periphery of the boss portion 8A substantially at an equal angular interval so as to extend in plural directions. In this embodiment, the four arm portions 8B are provided on the periphery of the boss portion 8A substantially at an angular interval of 90° so as to radially extend in four directions as shown in FIG. 1. That is, the driving shaft 15 is supported in the casing 3 by the bearing plate 8. The bearing plate 8 has opening portions (spaces) (not shown) each of which is defined between the respective adjacent arm portions (not shown) and through which the upper and lower spaces of the bearing plate 8 intercommunicate with each other.

A lower space which is located below the bearing plate 8 and in which an oil reservoir 40 is provided is kept under a high pressure. The lower cap 9 described above corresponds to the lower end portion of the oil reservoir 40. Oil is stocked at the inner bottom portion of the lower cap 9. An annular plate 59 is provided between the bearing plate 8 and the oil reservoir 40 so as to be fixed to the bearing plate 8. An oil supply path 41 as a part of high-pressure oil supply unit is formed in the driving shaft 15. The oil supply path 41 extends in the up-and-down direction in the driving shaft 15, and intercommunicates with an oil chamber 43 on the back surface of the swinging scroll 25. The oil supply path 41 is connected to an oil pickup 45 provided to the lower end of the driving shaft 15.

The oil pickup 45 has a suction port 42 provided to the lower end thereof, and a paddle 44 formed at the upper side of the suction port 42. The lower end of the oil pickup 45 is immersed in lubricant oil stocked in the oil reservoir 40, and the suction port 42 of the oil supply path 41 is opened in the lubricant oil. When the driving shaft 15 rotates, the lubricant oil stocked in the oil reservoir 40 gets into the oil supply path 41 from the suction port 42 of the oil pickup 45, and pumped up along the paddle 44 of the oil supply path 41. The thus-pumped lubricant oil is supplied through the oil supply path 41 to the respective sliding portions of the scroll compression mechanism 11 such as the radial bearing portion 28, the slewing bearing portion 24, etc. The lubricant oil is further supplied through the oil supply path 41 to the oil chamber 43 on the back surface of the swinging scroll 25, and further supplied from the oil chamber 43 through an intercommunication path 51 provided to the swinging scroll 25 to the compression chamber 35.

A return oil path 47 is formed in the main frame 21. The return oil path 47 radially penetrates from the boss mount portion 26 through the main frame 21, and opens to the longitudinal groove 71. Surplus lubricant oil out of the lubricant oil supplied through the oil supply path 41 to the respective sliding portions of the scroll compression mechanism 11 and the compression chamber 35 is returned through the return oil path 47 to the oil reservoir 40. An oil collector 46 is provided below the return oil path 47. The oil collector 46 extends to the neighborhood of the upper end of the spacer ring 38. Plural cutouts 54 are formed on the outer peripheral surface of the stator 37 in the up-and-down direction of the stator 37. The lubricant oil which is returned from the oil supply path 41 through the return oil path 47 and the oil collector 46 passes through the cutouts 54 and the gaps between the respective arm portions 8E of the bearing plate 8 and then is returned to the oil reservoir 40. In the cross-sectional view of FIG. 1, the discharge pipe 33 is represented by a broken line for simplification of the description, but the discharge pipe 33 is disposed to be out of phase with the oil collector 46.

The fixed scroll 23 comprises a mirror plate 23A and a spiral (involute) wrap 23B formed on the lower surface of the mirror plate 23A. The swinging scroll 25 comprises a mirror plate 25A and a spiral (involute) wrap 25B formed on the upper surface of the mirror plate 25A. The wrap 23B of the fixed scroll 23 and the wrap 25B of the swinging scroll 25 are engaged with each other, whereby plural compression chambers 35 are formed by both the wraps 23B and 25B between the fixed scroll 23 and the swinging scroll 25.

The swinging scroll 25 is supported through an Oldham's ring 61 by the fixed scroll 23. The cylindrical boss 25C having a bottom is provided at the center portion of the lower surface of the mirror plate 25A of the swinging scroll so as to project from the lower surface. The eccentric shaft portion 15A is provided to the upper end of the driving shaft 15. The eccentric shaft portion 15A is rotatably fitted in the boss 25C of the swing scroll 25.

Furthermore, the driving shaft 15 is provided with a counter weight portion (upper balancer) 63 at the lower side of the main frame 21. The driving shaft 15 is also provided with a lower balancer 77 at the lower portion of the rotor 39. The driving shaft 15 keeps dynamic balance with the swinging scroll 25, the eccentric shaft portion 15A, etc. by the upper balancer 63 and the lower balancer 77. The driving shaft 15 rotates with keeping the weight balance by the counter weight portion 63 and the lower balancer 77 to make the swinging roll 25 revolve. In connection with the revolution of the swinging scroll, the volume between the wraps 23B and 25B in the compression chambers 35 decreases as the position approaches to the center, whereby refrigerant sucked through the suction pipe 31 is compressed. The rotor 39 and the lower balancer 77 are integrally swaged by the rivet 91.

A cap 48 is fixed to the lower side of the main frame 21 so as to surround the periphery of the counter weight portion 63. The cap 48 prevents the lubricant oil leaking from the clearance between the main frame 21 and the driving shaft 15 from scattering to the discharge pipe side due to rotation of the counter weight portion 63.

A discharge hole 73 is provided to the center portion of the fixed scroll 23. Gas refrigerant discharged from the discharge hole 73 passes through a discharge valve 75, discharges through the discharge valve 75 to a discharge space 29 and flows out through the longitudinal groove 71 provided to the respective outer peripheries of the main frame 21 and the fixed scroll 23 to the high-pressure space 27 below the main frame 21. The high-pressure refrigerant which discharges from the discharge hole 73 and flows into the high-pressure space 27 is discharged to the outside of the casing 3 through the discharge pipe 33 provided to the casing body 5.

Subsequently, the driving operation of the scroll compressor 1 will be described.

When the driving motor 13 is driven, the rotor 39 rotates relatively to the stator 37, and the driving shaft 15 also rotates in connection with the rotation of the rotor 39. When the driving shaft 15 rotates, the swinging scroll 25 of the scroll compression mechanism 11 only revolves around the fixed scroll 23 without rotating on its axis. Accordingly, low-pressure refrigerant is sucked from the peripheral edge side of the compression chamber 35 through the suction pipe 31 into the compression chambers 35, and this refrigerant is compressed in connection with the volume variation of the compression chambers 35. The compressed refrigerant is set to high pressure, and discharged from the compression chambers 35 through the discharge valve 75 to the discharge space 29. The high-pressure refrigerant discharged to the discharge space 29 flows out to the high-pressure space 27 below the main frame 21 through the longitudinal groove 71 provided to the respective outer peripheries of the main frame 21 and the fixed scroll 23. The high-pressure refrigerant flowing into the high-pressure space 27 is discharged to the outside of the casing 3 through the discharge pipe 33 provided to the casing body 5. After the refrigerant discharged to the outside of the casing 3 is circulated in the refrigerant circuit (not shown), the refrigerant is passed through the suction pipe 31 again and sucked into the scroll compressor 1 to be compressed. The circulation of the refrigerant as described above is repeated.

Next, the flow of the lubricant oil will be described.

The lubricant oil stocked at the internal bottom portion of the lower cap 9 in the casing 3 is pumped up by the oil pickup 45, passed through the oil supply path 41 of the driving shaft 15 and supplied to the respective sliding portions of the scroll compression mechanism 11 and the compression chamber 35. The lubricant oil which is surplus at the respective sliding portions of the scroll compression mechanism 11 and the compression chamber 35 is collected from the return oil path 47 into the oil collector 46, passed through the cutouts 54 provided to the outer periphery of the stator 37 and returned to the lower side of the driving motor 13.

The insulator 19 disposed at the lower side of the stator core 37A is provided with a cover 95 formed of an insulating material such as resin or the like on inner side wall 19A of the insulator 19. The cover 95 is provided so as to cover the surrounding in the shaft direction of the driving shaft 15, and located so that the lower end surface 95A thereof extends to a position lower than the upper end surface of the boss portion 8A of the bearing plate 8. The cover 95 may be formed separately from the insulator 19, and engagedly fitted in the inside (inner hole) of the insulator 19 so as to be integrally fixed to the insulator 19. Alternatively, the cover 95 may be configured as a part of the insulator 19A by downwardly extending the inner side wall 19A of the insulator 19.

According to this construction, the surrounding in the shaft direction of the driving shaft 15 can be covered by the cover 95. Accordingly, the lubricant oil atomized due to the rotation of the driving shaft 15 can be enclosed inside the cover 95, so that the atomized lubricant oil can be prevented from reaching the gas flow path and the lubricant oil can be returned from the opening portion of the bearing plate 8 to the oil reservoir 40. Accordingly, the discharge amount of the lubricant oil to the outside of the casing can be reduced.

Figure 2:
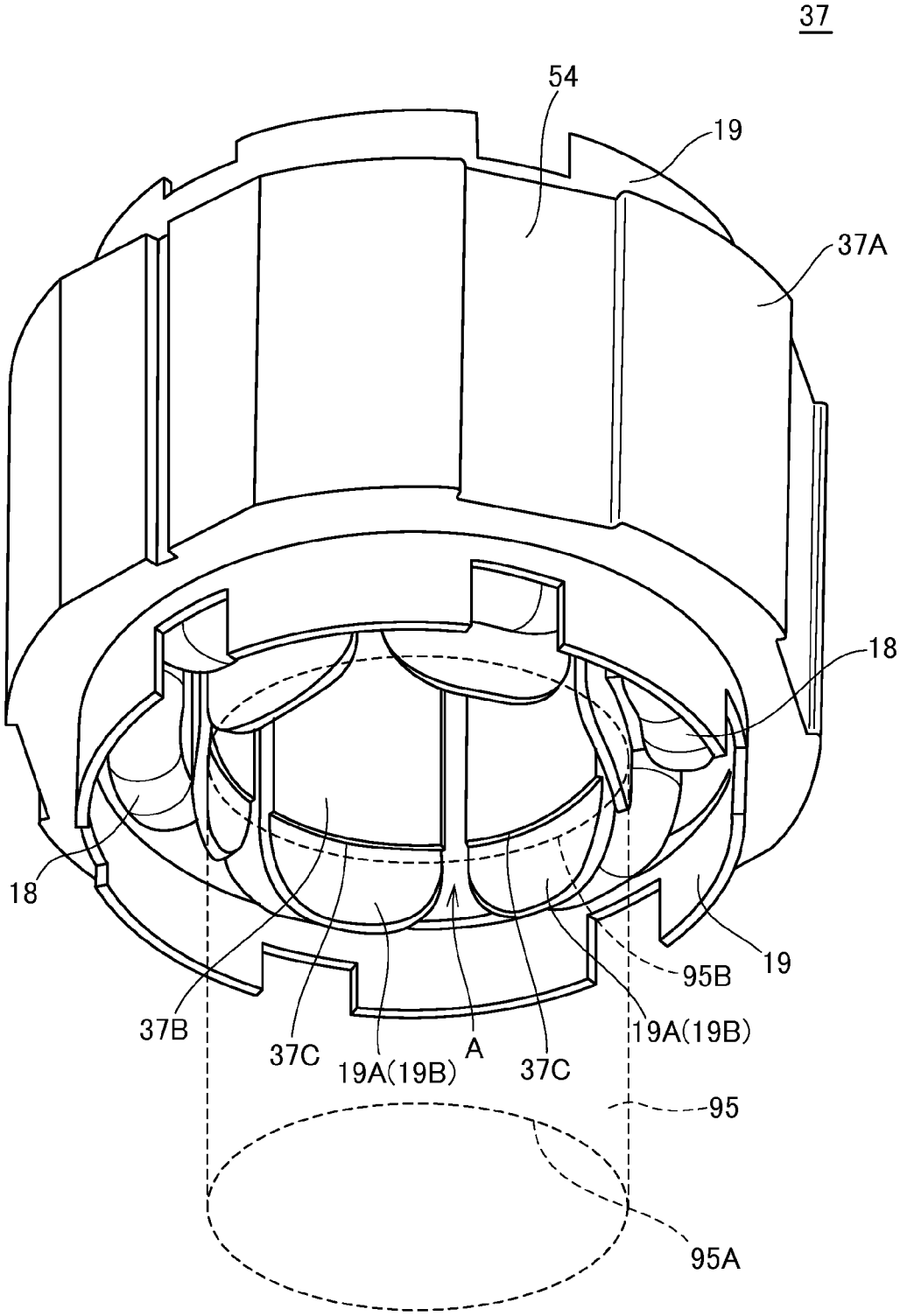
FIG. 2 is a perspective view showing a stator when the stator is viewed from the lower side.

As shown in FIG. 2, the inner side wall 19A of the insulator 19 is divided into plural plate members 19B. The lower end of each plate member 19B is designed in a semi-circular or semi-elliptic shape. Each plate member 19B extends downwardly from the magnetic steel plate 37B of the stator 37. The cover 95 is disposed so that the upper end 95B is maximally proximate to the lower end 37C of the electromagnetic steel plate 37B. That is, the cover 95 is provided inside the plate members 19B (in the space defined by the plate members 19B) so that the gap between the cover 95 and the electromagnetic steel plate 37B is as small as possible. Accordingly, gaps A formed between the respective adjacent plate members 19B can be covered by the cover 95. According to this construction, the cover 95 is provided so as to cover each gap which is formed between the plate members 19 in a winding process of the stator 37, whereby the lubricant oil atomized due to the rotation of the driving shaft 15 can be prevented from leaking from each gap between the plate members 19B to the gas flow path. Accordingly, the discharge amount of the lubricant oil to the outside of the casing can be reduced.

As described above, according to the embodiment to which the present invention is applied, the scroll compression mechanism 11 for compressing refrigerant and the driving motor 13 that is connected to the scroll compression mechanism 11 through the driving shaft 15 to drives the scroll compression mechanism 11 are mounted in the casing 3, the scroll compression mechanism 11 is supported in the casing 3 by the main frame 21, the driving shaft 15 of the driving motor 13 is supported in the casing 3 by the bearing plate 8, and the cover 95 for covering the surrounding of the driving shaft 15 is provided between the driving motor 13 and the bearing plate 8. The cover 95 is formed by using an insulating material, and it is provided to the insulator 19 of the stator coil 18 of the driving motor 13. Accordingly, the lubricant oil which is atomized in the space between the driving motor 13 and the bearing plate 8 due to the rotation of the driving shaft 15 can be enclosed inside the cover 95, and thus prevented from reaching the gas flow path. Accordingly, the discharge amount of the lubricant oil to the outside of the casing 3 can be reduced.

According to this embodiment to which the present invention is applied, the cover 95 is provided to the inner side wall 19A of the insulator 19, and the lower end 95A of the cover 95 extends to a position lower than the upper end surface of the boss portion 8A of the bearing plate 8 in which the driving shaft 15 is inserted. Accordingly, the atomized lubricant oil enclosed inside the cover 95 can be prevented from reaching the gas flow path, and can be easily returned from the opening portion (space) between the arm portions 8B of the bearing plate 8. Accordingly, the discharge amount of the lubricant oil to the outside of the casing 3 can be reduced.

According to the embodiment to which the present invention is applied, the cover 95 is provided so that the upper end 95B of the cover 95 is disposed to be proximate to the lower ends 37C of the electromagnetic steel plates of the stator 37 of the driving motor 15. Accordingly, the gaps formed in the inner side wall 19A of the insulator 19 in the winding process of the stator 37 can be covered by the cover 95, and the lubricant oil atomized due to the rotation of the driving shaft 15 can be prevented from reaching the gas flow path from the gaps formed in the inner side wall 19A. Accordingly, the discharge amount of the lubricant oil to the outside of the casing can be reduced.

What is claimed is:

1. A scroll compressor, comprising:

a casing;

a scroll compression mechanism that compresses refrigerant;

a driving motor that has a driving shaft, an insulator and a stator, and is connected to the scroll compression mechanism through the driving shaft to drive the scroll compression mechanism;

a main frame that supports the scroll compression mechanism in the casing;

a bearing plate that has a boss portion in which the driving shaft is inserted, and supports the driving shaft of the driving motor in the casing; and a cover that covers a surrounding of the driving shaft between the driving motor and the bearing plate and is formed of an insulating material and provided to the insulator of the driving motor, wherein a lower end of the cover extends to a position lower than an upper end surface of the boss portion of the bearing plate, the lower end of the cover is provided apart from the bearing plate.

2. The scroll compressor according to claim 1, wherein the cover is provided to an inner wall side of the insulator.

3. The scroll compressor according to claim 2, wherein the stator has electromagnetic steel plates, an inner side wall of the insulator is divided into plural plate members that extends downwardly from the electromagnetic steel plates, and an upper end of the cover is provided so as to cover each gap which is formed between the adjacent plate members and lower ends of the electromagnetic steel plates.

4. The scroll compressor according to claim 1, wherein the stator has electromagnetic steel plates, an inner side wall of the insulator is divided into plural plate members that extends downwardly from the electromagnetic steel plates, and an upper end of the cover is provided so as to cover each gap which is formed between the adjacent plate members and lower ends of the electromagnetic steel plates.

* * * * *